US011154888B2

(12) United States Patent
Lee et al.

(10) Patent No.: US 11,154,888 B2
(45) Date of Patent: Oct. 26, 2021

(54) SPRAY PUMP

(71) Applicant: SAMHWAP&T CO., LTD, Uiwang-si (KR)

(72) Inventors: Kyungchang Lee, Uiwang-si (KR); Joonhong Lee, Siheung-si (KR)

(73) Assignee: SAMHWAP&T CO., LTD, Uiwang-si (KR)

( * ) Notice: Subject to any disclaimer, the term of this patent is extended or adjusted under 35 U.S.C. 154(b) by 0 days.

(21) Appl. No.: 17/269,264

(22) PCT Filed: Oct. 24, 2018

(86) PCT No.: PCT/KR2018/012607

§ 371 (c)(1),
(2) Date: Feb. 18, 2021

(87) PCT Pub. No.: WO2020/059944

PCT Pub. Date: Mar. 26, 2020

(65) Prior Publication Data

US 2021/0178413 A1 Jun. 17, 2021

(30) Foreign Application Priority Data

Sep. 20, 2018 (KR) ..... 10-2018-0112566

(51) Int. Cl.
*B05B 11/00* (2006.01)

(52) U.S. Cl.
CPC ..... *B05B 11/3001* (2013.01); *B05B 11/3047* (2013.01); *B05B 11/3052* (2013.01); *B05B 11/3067* (2013.01); *B05B 11/3074* (2013.01)

(58) Field of Classification Search
CPC ..... B05B 11/3001; B05B 11/3074; B05B 11/3052; B05B 11/3067; B05B 11/3047
See application file for complete search history.

(56) References Cited

U.S. PATENT DOCUMENTS 2,035,599 A * 3/1936 Irving ..... B05B 11/3001 239/333
3,053,459 A * 9/1962 Corsette ..... B05B 11/3001 239/337

(Continued)

FOREIGN PATENT DOCUMENTS

KR 20-1990-0015432 U 9/1990
KR 20-0295502 Y1 11/2002

(Continued)

OTHER PUBLICATIONS

International Search Report in International Application No. PCT/KR2018/012607, dated Jun. 11, 2019, 3pages.

*Primary Examiner* — Donnell A Long
(74) *Attorney, Agent, or Firm* — Park, Kim & Suh, LLC

(57) ABSTRACT

A spray pump is disclosed. A spray pump according to an aspect of the present invention comprises: a housing having an inflow space, the housing being coupled to a container entrance; a housing cover coupled to the upper end of the housing; a disk for opening or closing the housing according to the pressure in the inflow space; a valve movably inserted into the housing cover, the valve comprising a valve head and a valve body communicating with the valve head; a guide having a part inserted into the valve body and the remainder positioned on the outside of the valve body, the guide having a guide passage corresponding to a channel through which content is discharged; a valve spring for providing an elastic force that pressurizes the valve upwards; a piston movably inserted into the outer peripheral surface of the guide so as to open or close the guide passage by means of upward/downward movements of the valve; a nozzle coupled to the valve head and having an insert insertion portion; and an insert inserted into the insert insertion portion and having an orifice. The valve head has (Continued)

a valve passage communicating with the guide passage. The valve passage has a valve helical groove formed on the inner peripheral surface thereof.

8 Claims, 5 Drawing Sheets

(56) References Cited

U.S. PATENT DOCUMENTS

| | | | | | |
|---|---|---|---|---|---|
| 3,949,939 | A * | 4/1976 | Brown | B05B 11/3001 239/350 |
| 4,830,284 | A * | 5/1989 | Maerte | B05B 11/0067 239/333 |
| 5,988,449 | A * | 11/1999 | Fuchs | B05B 11/0067 222/189.11 |
| 2017/0225182 | A1 * | 8/2017 | Bruder | B05B 11/0062 |

FOREIGN PATENT DOCUMENTS

| | | | |
|---|---|---|---|
| KR | 10-1233080 | B1 | 2/2013 |
| KR | 10-2013-0128618 | A | 11/2013 |
| KR | 10-1661575 | B1 | 10/2016 |
| KR | 10-2018-0100259 | A | 9/2018 |

* cited by examiner

SPRAY PUMP

CROSS-REFERENCE TO RELATED APPLICATIONS

This application is the National Stage filing under 35 U.S.C. 371 of International Application No. PCT/KR2018/012607, filed on Oct. 24, 2018 which claims the benefit of Korean Patent Application No. 10-2018-0112566, filed on Sep. 20, 2018, the contents of which are all hereby incorporated by reference herein in their entirety.

BACKGROUND

Technical Field

The present invention relates to a spray pump capable of spraying a content in a uniform manner.

Description of the Related Art

In a cosmetic container and the like, a spray pump may be coupled to the opening at the upper part of a container holding a liquid content such as a perfume, etc., to eject and spray the content to the exterior in designated amounts. When the user presses down on a nozzle corresponding to a button so as to spray the liquid content, the content that had entered the inside of the spray pump may be pressurized, move upward along the discharge passage, and be sprayed through the nozzle. When the pressure on the nozzle is released, the discharge passage may be mechanically closed by the rising of the nozzle, the pressure inside the pump may be lowered, and the content may be drawn in from the container to make up for the pressure loss.

A spray pump such as the above is being used not only for spraying perfumes and cosmetics but also a variety of other contents such as air fresheners, insecticides, etc. Due to the convenience of ejecting designated amounts of a content with a single pressing of the nozzle button, without having the content exposed to the exterior, use of the spray pump continues to grow.

A conventional spray pump may have the orifice, for spraying the content, formed with a very small diameter in order to spray the content in the form of fine particles. As a result, it may occur that the pumped liquid content is unable to easily pass through the orifice having a small diameter, and this in turn can result in an inability to eject a content in a uniform manner.

SUMMARY OF THE INVENTION

Technical Problem

The present invention, which has been derived to resolve the problem above, aims to provide a spray pump that is capable of ejecting a content in a uniform manner.

Also, the present invention aims to provide a spray pump that can prevent the content from being contaminated by preventing the content from directly contacting parts made from metallic materials.

Other objectives of the present invention will be more clearly appreciated from the embodiments set forth below.

Technical Solution

A spray pump according to one aspect of the present invention may include: a housing that has an inflow space and is configured to be coupled to the opening of a container; a housing cover that is coupled to an upper end of the housing; a disk that is configured to open or close the housing according to the pressure of the inflow space; a valve that is movably inserted through the inside of the housing cover and includes a valve head and a valve body connecting with the valve head; a guide that has a portion inserted in the valve body and a remaining portion positioned outside the valve body and includes a guide passage corresponding to a flow path for discharging a content; a valve spring that is configured to provide an elastic force pressing the valve upward; a piston that is movably inserted onto the outer perimeter of the guide and is configured to open or close the guide passage by way of a vertical movement of the valve; a nozzle that is coupled to the valve head and includes an insert holder part; and an insert that is inserted in the insert holder part and includes an orifice, where the valve head may include a valve passage that connects with the guide passage, and a valve helical groove may be formed in the inner perimeter of the valve passage.

A spray pump based on the present invention can include one or more of the following features. For example, the valve spring can be inserted onto the periphery of the valve and can have one end supported by the housing cover.

The spray pump can include a piston spring that is positioned around the piston and is configured to press the piston downward, where the piston spring can have one end supported by the piston and the other end supported by the valve.

The guide passage can include a first guide passage, which may be formed in the periphery of the guide, and a second guide passage, which may connect with the first guide passage and may be formed along the lengthwise direction of the guide to connect directly with the valve passage, and the piston can be capable of opening or closing the first guide passage.

The valve helical groove can be formed in two or more lines.

A guide helical groove that connects with the valve helical groove can be formed in the inner perimeter of the second guide passage.

A gap that allows an entry of air to the inside of the container can be formed at the coupling portion between the valve and the housing cover and at the coupling portion between the housing cover and the housing.

The piston can include an inner piston, which may be configured to be movably inserted onto the periphery of the guide while maintaining tight contact, and an outer piston, which may be separated from the inner piston by a particular gap in a radial direction and may be configured to tightly contact the inner perimeter of the housing, and the housing can include a curb step on which the outer piston may be caught.

Advantageous Effects

The present invention can provide a spray pump that is capable of ejecting a content in a uniform manner.

Also, the present invention can provide a spray pump that can protect the content from contamination by preventing direct contact between the content and parts made from metallic materials.

DETAILED DESCRIPTION OF THE INVENTION

Figure 1:
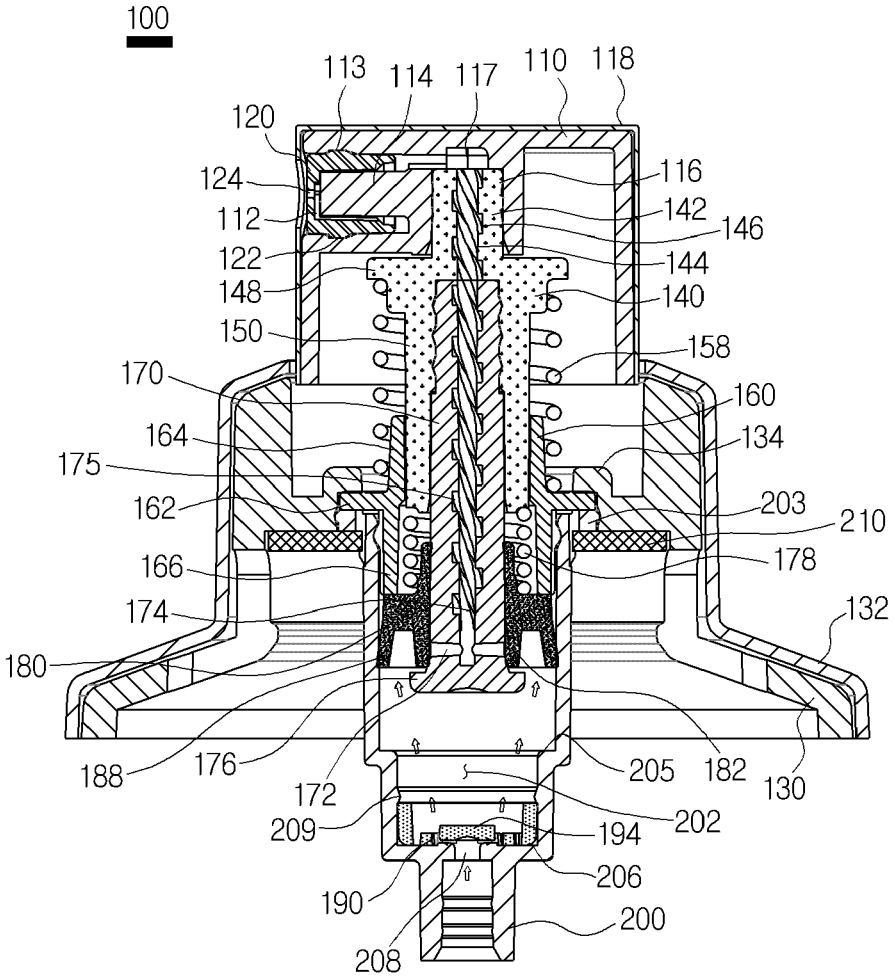
FIG. 1 is a cross-sectional view illustrating a spray pump according to an embodiment of the present invention.

Below, a detailed description is provided of certain embodiments of the present invention, with reference to the appended drawings. In the descriptions referencing the appended drawings, the same reference numerals are assigned to the same or corresponding elements, regardless of the figure number, and redundant descriptions are omitted.

Figure 2:
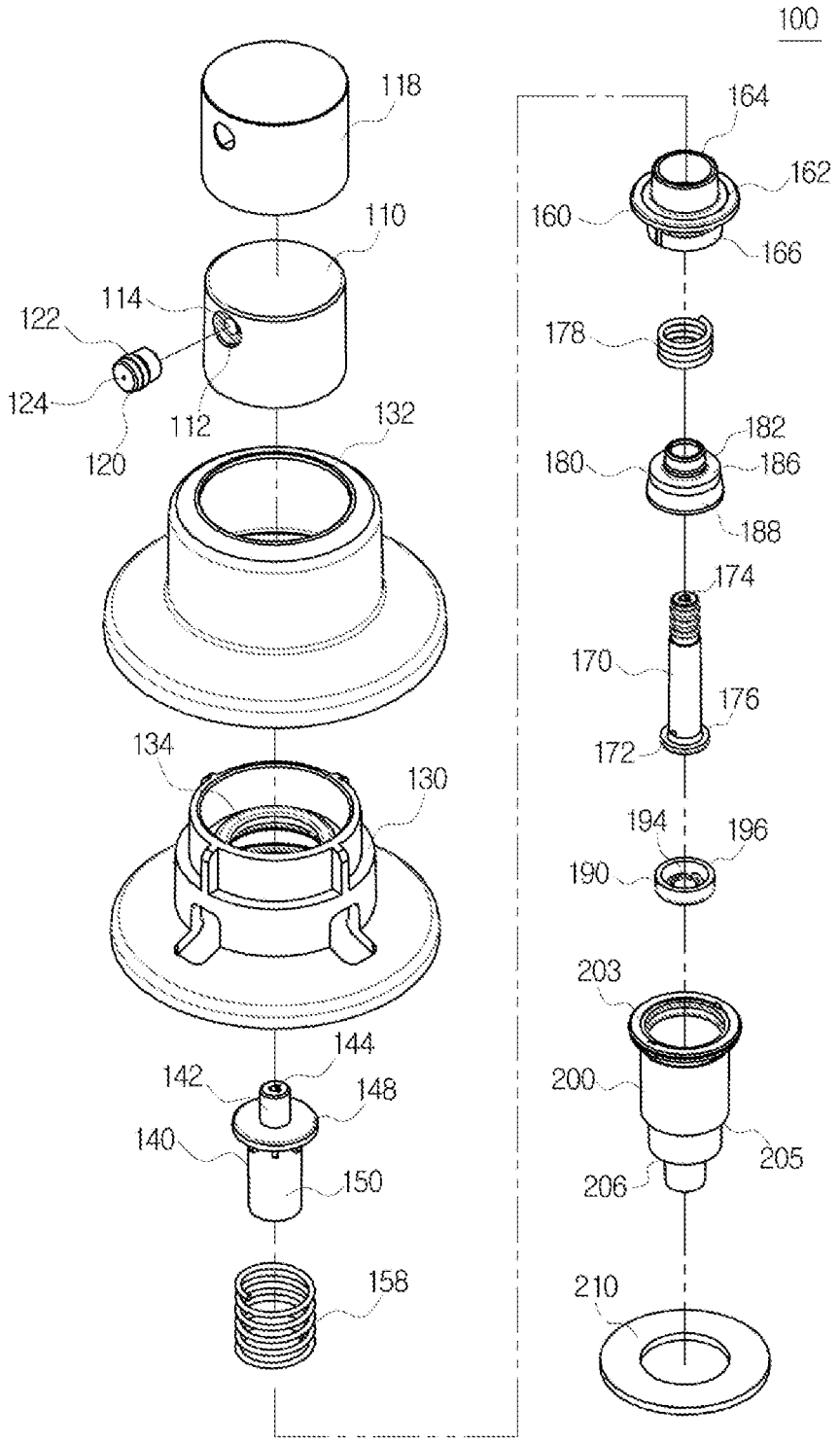
FIG. 2 is an exploded perspective view of the spray pump illustrated in FIG. 1.
Figure 3:
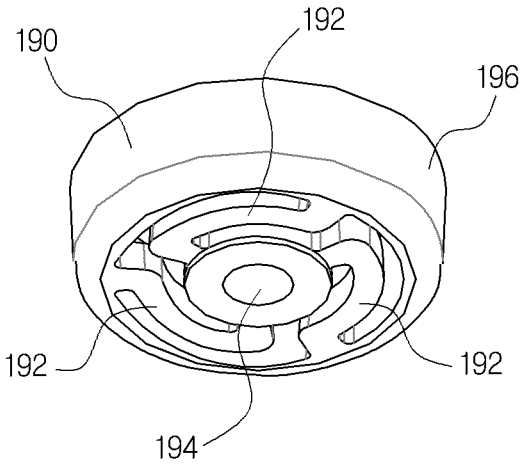
FIG. 3 is a perspective view illustrating the disk in a spray pump according to an embodiment of the present invention.

FIG. 1 is a cross-sectional view illustrating a spray pump 100 according to an embodiment of the present invention, and FIG. 2 is an exploded perspective view of the spray pump 100 illustrated in FIG. 1. FIG. 3 is a perspective view illustrating the disk 190 in a spray pump 100 according to an embodiment of the present invention.

Incidentally, FIG. 1 illustrates the spray pump 100 when there is no external force applied, so that the nozzle 110 is raised as much as possible. Also, in FIG. 1, the arrows illustrate the flow of the content entering the inside of the housing 200.

Referring to FIGS. 1 to 3, a spray pump 100 according to this embodiment can be coupled to the upper end of a container (not shown) to spray a liquid content, which was injected into the container, in the form of fine particles, etc. The spray pump 100 according to this embodiment is not limited by the type or material of the coupled container or by the form, quality, and type of the sprayed content.

A cap 130 may be coupled to the opening of the container, and a cap cover 132 may be coupled to an upper portion of the cap 130. A packing 210 can be provided between the container and the cap 130 to prevent the content from leaking to the exterior. Also, a cover flange 162 of a housing cover 160 may be positioned between the packing 210 and an internal protrusion 134 of the cap 130. This may prevent the housing cover 160 from moving in position with respect to the cap 130.

The cap cover 132 may be coupled to an upper portion of the cap 130 to prevent the outer surface of the cap 130 from being exposed to the exterior. At the upper end of the cap cover 132, a through-hole (no number assigned) may be formed, through which a nozzle 110 and a nozzle cap 118 can be inserted in a manner that allows vertical movement. Between the nozzle cap 118 and the cap cover 132, a gap may be formed, through which air can enter into the inside of the housing 200 and the inside of the container.

The housing 200 may be positioned at the lowermost portion of the spray pump 100 and may provide an inflow space 202, which may be positioned within the container and into which the content can enter. The housing 200 may be structured such that the upper end and the lower end are both open and may have the inflow space 202 formed inside into which the content can enter. A housing cover 160 may be coupled to an upper portion of the housing 200.

The inflow space 202 of the housing 200 may correspond to a space that can receive an entry of the content through a disk 190. When the nozzle 110, piston 180, and guide 170 are raised so that the pressure within the inflow space 202 is a vacuum or a near-vacuum, the content may be drawn into the inflow space 202, as the pressure in the container is higher than in the inflow space 202 (see the arrows of FIG. 1). Since the upper portion of the inflow space 202 is closed by the piston 180 and the guide 170, the content may not flow to the exterior and may remain only in the inflow space 202, when the nozzle 110 is not in a pressed state.

At the upper end of the housing 200, an outwardly protruding housing flange 203 may be formed. The housing flange 203 may be caught on the packing 210. Also, the cover flange 162 of the housing cover may be positioned at an upper portion of the housing flange 203. The cover flange 162 may be pressed downward by the internal protrusion 134 of the cap 130, and as a result, the housing 200 may also be coupled to be constricted in vertical movement with respect to the container.

On the inner perimeter of the housing 200, there may be formed an inwardly protruding curb step 205. When the nozzle 110 is moved downward, a lower end of the piston 180 may be caught on the curb step 205 (see FIG. 4). As a result, the piston 180 may not move downward any further, and only the guide 170 may move downward, so that a first guide passage 172 may be exposed and connected with the inflow space 202.

Below the curb step 205 on the inner perimeter of the housing 200, a mount step 206 may be formed. The disk 190 may be mounted on the mount step 206. The disk 190, positioned on the mount step 206, may open or close an inflow hole 208 according to changes in pressure in the inflow space 202 and in the container.

Between the curb step 205 and the mount step 206, a disk protrusion 209 may protrude inward. The disk protrusion 209 may prevent the disk 190 from being moved vertically from the mount step 206 by a pressure difference and becoming detached from its original position.

The housing cover 160 may be coupled to an upper portion of the housing 200 and may have a valve 140 penetrating therethrough. The housing cover 160 may include, with respect to the cover flange 162, a cover upper part 164 that protrudes upward and a cover lower part 166 that protrudes downward.

The cover lower part 166 may be inserted through an upper portion of the housing 200. The valve 140 may be inserted into the hollow cavity of the cover lower part 166. Referring to FIG. 1, a gap for forming an air passage 168 may be formed between the outer perimeter of the cover lower part 166 and the inner perimeter of the housing 200. A gap for forming an air passage may also be formed between the inner perimeter of the cover lower part 166 and the outer perimeter of the valve 140. Through such an air passage, air from the exterior may enter the housing 200 and subsequently enter the container.

The cover flange 162 may be a portion that protrudes outward in a certain length from the outer perimeter of the housing cover 160. The diameter of the cover flange 162 can be the same or almost the same as the diameter of the housing flange 203 of the housing 200. Thus, the cover flange 162 may be mounted on the upper portion of the housing flange 203. Also, the cover flange 162 may be pressed downward by the internal protrusion 134 of the cap 130. As a result, any vertical movement of the housing cover 160 may be prevented. The upper surface of the cover flange 162 may contact the lower end of the valve spring 158.

The cover upper part 164 may be a hollow tube that protrudes upward from the cover flange 162 and may have the valve 140 penetrating therethrough. A valve spring 158 may be positioned around the cover upper part 164. When the nozzle 110 is pressed downward, the end portion of the cover upper part 164 may contact the valve 140, preventing any further downward movement of the valve 140 (see FIG. 4).

The valve 140 may be inserted through the inside of the housing cover 160 and may move vertically with respect to the housing cover 160 so as to open or close the flow path through which the content may be discharged. The valve 140 may be structured as a hollow tube, with both the upper end and lower end open, and may include a valve head 142, a valve flange 148, and a valve body 150.

The valve head 142 may be a hollow tube of a small diameter and may be inserted into the inside of the nozzle 110. The valve head 142 may include a valve passage 144 that penetrates therethrough along its entire lengthwise direction. The valve passage 144 may be the part through which the content that has been transported through the guide 170 passes, and the content that passes through the valve passage 144 may be sprayed through the nozzle 110 and the insert 120 to the exterior.

In the inner perimeter of the valve passage 144, a valve helical groove 146 having the shape of a helical groove may be formed over the entire lengthwise direction. The valve helical groove 146 can guide the movement of the content flowing through the valve passage 144 such that a vertical flow is formed. As the flow of the content is changed from a simple flow to a vortical flow, the content can be sprayed uniformly from the nozzle 110.

The valve helical groove 146 can be formed in two or more lines. Also, the valve helical groove 146 can be connected with a guide helical groove 175, which can be formed in a second guide passage 174 of the guide 170.

The valve flange 148 may protrude outward at the lower end of the valve head 142 and may have a multi-stepped structure. A lower surface of the valve flange 148 may contact the valve spring 158. Thus, the valve 140 may receive an upwardly pressing elastic force applied by the valve spring 158. Also, the valve flange 148 can contact the upper end of the housing cover 160.

The valve body 150 may be movably inserted at the center of the housing cover 160. Also, the valve body 150 may have a guide 170 inserted therein over the entire lengthwise direction. The guide 170 may not move vertically with respect to the valve body 150. As a result, the valve 140 and the guide 170 may move vertically as an integrated body. Also, a gap for forming an air passage may be formed between the outer perimeter of the valve body 150 and the inner perimeter of the housing cover 160.

The valve spring 158 may be positioned between the housing cover 160 and the valve 140 to provide an elastic force that moves the valve 140 upward. Since the housing cover 160 and the housing 200 do not move vertically with respect to the container, only the valve 140 and the guide 170 may move vertically. That is, when an external force is applied, the valve 140 and the guide 170 may be moved downward (see FIG. 4), and when the external force is removed, the valve 140 and the guide 170 may be moved upward by the elastic restoring force of the valve spring 158 and returned to their original positions (see FIG. 1).

The valve spring 158 may not contact the content while positioned around the valve 140 and housing cover 160. Thus, any contamination of the content by the metallic material of the valve spring 158 can be prevented, and the problem of the durability of the valve spring 158 being lowered by the content can be avoided.

The guide 170 may move vertically as an integrated body with the valve 140 and may provide guide passages 172, 174 through which the content can move. The guide 170 may be shaped as a hollow cylinder and may have a guide head 176 formed at its lower end, where the guide head 176 may have a larger diameter. Also, a portion of the guide 170 may be inserted in the valve 140, while a remaining portion may be exposed outside the valve 140. A piston spring 178 and a piston 180 may be positioned around the portion of the guide 170 that is exposed outside the valve 140.

The guide passage may include a first guide passage 172 and a second guide passage 174.

The first guide passage 172 may be formed perpendicularly to the lengthwise direction of the guide 170, and its opening may be formed in the outer perimeter of the guide 170. It is possible to have two or more first guide passages 172, of which the other ends may all connect with the second guide passage 174. The first guide passage 172 can be formed adjacent to the guide head 176 formed at the lower end of the guide 170.

The first guide passage 172 can be opened or closed by the piston 180. That is, when the nozzle 110 is raised, the first guide passage 172 may be closed by the piston 180 (see FIG. 1), with the result that the content within the inflow space 202 may not be sprayed. When the nozzle 110 is lowered, the first guide passage 172 may move beyond the piston 180 and be opened (see FIG. 4), with the result that the content can move through the first guide passage 172.

The second guide passage 174 may be formed in a direction perpendicular to that of the first guide passage 172, in the lengthwise direction of the guide 170. The upper end of the second guide passage 174 may connect with the valve passage 144.

In the inner perimeter of the second guide passage 174, a guide helical groove 175 of a helical shape can be formed. As the second guide passage 174 corresponds to the passage through which the content moves, the content while moving can be made to form a vortical flow by the guide helical groove 175. The vertical flow thus formed makes it possible to spray the content in a uniform manner.

The guide head 176 may be formed at the lower end of the guide 170 with a diameter somewhat larger than the diameter of the guide 170. The guide head 176 may have an outer diameter that is larger than the inner diameter of the inner piston 182. Thus, when the nozzle 110 is raised, the guide head 176 may be caught on the inner piston 182, which may limit the rising of the guide 170. Also, when the movement of the guide 170 is stopped, the movement of the valve 140, nozzle 110, and nozzle cap 118, which move together as an integrated body, may be stopped as well.

The piston 180 may be inserted onto the periphery of the guide 170 and may move vertically along the lengthwise direction of the guide 170 to open or close the first guide passage 172. The piston 180 may include an inner piston 182, a piston flange 186, and an outer piston 188.

The inner piston 182 may have the shape of a hollow tube, and at the inside of the inner piston 182, the guide 170 may be inserted in a movable manner. The inner perimeter of the inner piston 182 may tightly contact the outer perimeter of the guide 170 such that the content does not leak out. For implementing such a sealing function, the piston 180 can be formed from a flexible material such as rubber, etc.

The lower portion of the inner piston 182 can open or close the first guide passage 172. That is, depending on the relative positions of the guide 170 and the piston 180, the first guide passage 172 can be opened or closed by the inner piston 182.

On the outer perimeter of the inner piston 182, a piston flange 186 may be formed that has a certain length in the radial direction. The piston flange 186 can be formed in the middle of the inner piston 182 along the lengthwise direction. At the end portion of the piston flange 186, an outer piston 188 may protrude downward.

As illustrated in FIG. 1, when the nozzle 110 is raised up, the upper surface of the piston flange 186 may contact the lower end of the housing cover 160, whereby the rising of the piston 180 may be stopped. Also, the upper surface of the piston flange 186 may contact the lower end of the piston spring 178. Thus, the piston 180 may receive a downwardly pressing force applied by the piston spring 178, whereby the piston 180 may be positioned to be able to close the first guide passage 172 while separated from the valve 140 (see FIG. 1).

The outer perimeter of the outer piston 188 may tightly contact the inner perimeter of the housing 200. As a result, the content that had entered the inside of the housing 200 can be prevented from leaking out. Also, the lower end of the outer piston 188 may be caught on the curb step 205 of the housing 200, with the result that the movement of the piston 180 may be limited. However, the guide 170 that is movably inserted through the inside of the piston 180 can undergo a further downward movement, with the result that the first guide passage 172 may move beyond the inner piston 182 and be exposed outside (see FIG. 4).

The piston spring 178 may not be positioned in the inflow space 202 but rather may be positioned outside, i.e. around the upper portion of the piston 180. This can prevent contamination of the content, since the piston spring 178 may not come into contact with the content.

The disk 190 may, while positioned on the mount step 206 within the housing 200, open or close the inflow hole 208 according to the pressure inside the inflow space 202. The disk 190 can be formed from a material having an elastic quality such as rubber, flexible plastic, etc. The disk 190 may include a connection member 192, an operating plate 194, and a disk body 196.

The disk body 196 may be the portion that is placed on the mount step 206 and may form the outer body of the disk 190. An upper end of the disk body 196 may be caught on the curb step 205, whereby the disk 190 may be prevented from becoming detached from the mount step 206.

The connection member 192 may correspond to a portion that connects the disk body 196 with the operating plate 194. The connection member 192 can be formed from a material having an elastic quality to be capable of changing length. This allows the operating plate 194 to move upward from its original position (see FIG. 4).

The operating plate 194 may be connected to the connection member 192 and may open or close the inflow hole 208. The diameter of the operating plate 194 can be formed somewhat larger than the diameter of the inflow hole 208.

Figure 4:
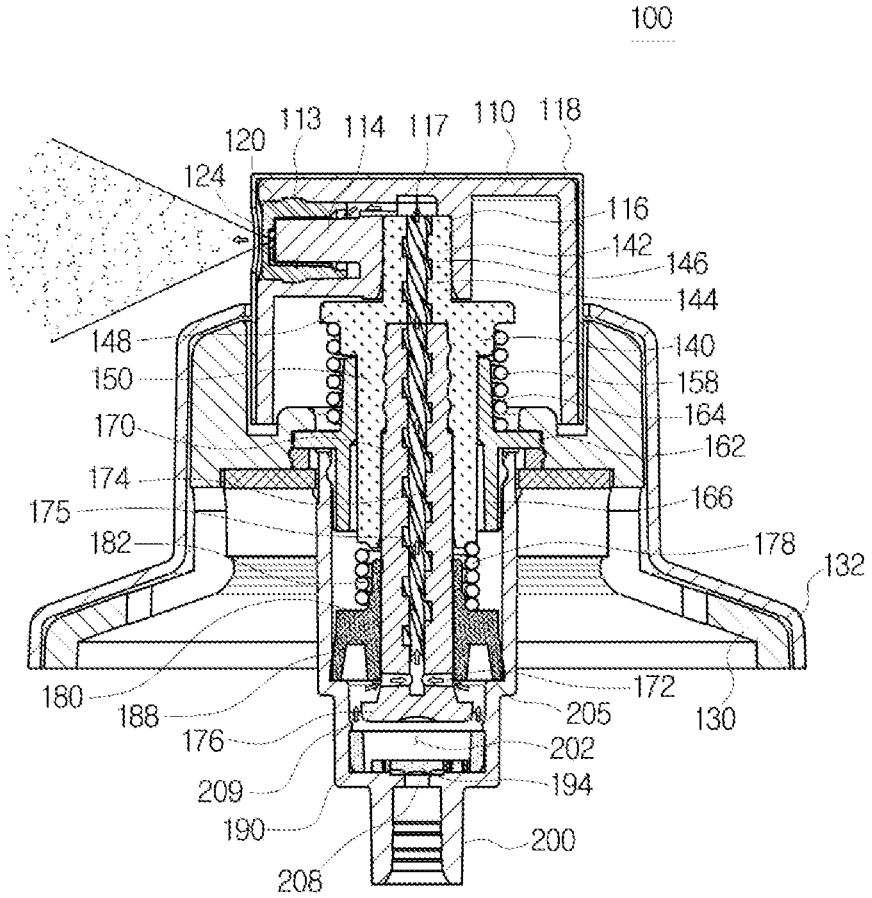
FIG. 4 is a cross-sectional view illustrating the spray pump in FIG. 1 when the nozzle is moved downward.

As illustrated in FIG. 1, when the pressure inside the inflow space 202 is lower compared to the inside of the container, the operating plate 194 may be raised due to the pressure difference, and the inflow hole 208 may be opened. As a result, the content within the container may be moved to the inflow space 202. Also, as illustrated in FIG. 4, when the pressure inside the inflow space 202 is higher compared to the inside of the container, the operating plate 194 may remain at its original position to close the inflow hole 208. As a result, the content in the container cannot move to the inflow space 202, and the content that had already entered the inflow space 202 may be sprayed through the nozzle 110 to the exterior.

The nozzle 110 may be coupled to the upper end of the valve 140 and may continue from the valve 140 to provide a passage through which the content may be discharged. Also, the nozzle 110 may protrude to the outside of the cap 130 to be positioned for pressing by the user. At an upper portion of the cap 130, a space may be formed in which the nozzle 110 can move vertically.

In the center on the inside of the nozzle 110, a valve holder cavity 116 may be formed into which the valve head 142 can be inserted. The valve head 142 may be inserted into the valve holder cavity 116 by way of press fitting. Thus, the nozzle 110 may be prevented from moving and rotating with respect to the valve 140.

The valve holder cavity 116 may connect with the nozzle passage 117. Thus, the content that has passed through the valve passage 144 of the valve head 142 may pass through the nozzle passage 117 and be sprayed to the exterior. The nozzle passage 117 can correspond to a cavity formed in the upper surface of the nozzle 110.

The nozzle 110 can have a cylindrical shape of which only the lower side is open. Also, on the outer perimeter of the nozzle 110, an insert holder part 112 can be formed. An insert 120 may be inserted in the insert holder part 112. In the inner perimeter of the insert holder part 112, an insert groove 113 may be formed. A detent protrusion 122 formed on the outer perimeter of the insert 120 may be inserted in the insert groove 113. As a result, even as the content is sprayed, the insert 120 may not become detached from the insert holder part 112.

On the inside of the insert holder part 112, an insert protrusion 114 may be formed. The insert protrusion 114 can be a protrusion formed in a horizontal direction of the nozzle 110 and can have a cylindrical shape. The insert 120 may be inserted onto the periphery of the insert protrusion 114. A gap may be present between the outer perimeter of the insert protrusion 114 and the inner perimeter of the insert 120, and the content may be sprayed through this gap to the exterior of the nozzle 110.

A nozzle cap 118 can be coupled to the exterior of the nozzle 110.

The insert 120 may be shaped as a hollow cylinder having only one end open and may be inserted onto the insert holder part 112. In the surface of the closed other end of the insert 120, an orifice 124 may be formed. The content may be sprayed through the orifice 124 in the form of fine particles. Between the closed other end of the insert in which the orifice 124 is formed and the end of the insert protrusion 114, a certain gap may be formed through which the content can move.

On the outer perimeter of the insert 120, a detent protrusion 122 may be formed. The detent protrusion 122 may be inserted in the insert groove 113 to prevent the insert 120 from becoming detached.

The following describes the operation of a spray pump 100 according to this embodiment, with reference to FIG. 1 and FIG. 4.

FIG. 4 is a cross-sectional view illustrating the spray pump in FIG. 1 when the nozzle 110 is moved downward. The arrows in FIG. 4 illustrate the discharge path of the content.

As illustrated in FIG. 1, when there is no external force applied on the nozzle 110, the positions of the nozzle 110, valve 140, and guide 170 may be raised as much as possible by the valve spring 158. Also, the rising of the guide 170 may cause the piston 180 to be raised as well, to be raised as much as possible at a position caught on the lower end of the housing cover 160. Here, the piston 180 may close the first guide passage 172 of the guide 170.

The rising of the valve 140 and guide 170 may lower the pressure of the inflow space 202 inside the housing 200, forming a vacuum or a near-vacuum state. The inside of the container may maintain atmospheric pressure due to the inflow of outside air described later on. Therefore, as the pressure inside the container is higher than the pressure inside the inflow space 202, the disk body 196 may be raised by the pressure difference, and the inflow hole 208 may be opened. As the inflow hole 208 is opened, the content held in the container may be suctioned into the inflow space 202 (see arrows of FIG. 1).

Here, the inner piston 182 may tightly contact the outer perimeter of the guide 170 to prevent any leaking of the content and to maintain the vacuum state of the inflow space 202. Also, the outer piston 188 may tightly contact the inner perimeter of the housing 200 to prevent any leaking of the content and to maintain the vacuum state of the inflow space 202.

From the state illustrated in FIG. 1, when the nozzle 110 is pressed downward in order to spray the content, the valve 140 and the guide 170 may move downward together with the nozzle 110. Also, the force moving the valve 140 downward may be transferred through the piston spring 178 to the piston 180, causing the piston 180 to move downward as well. However, during the movement, the piston 180 may have its lower end caught on the curb step 205, whereby the movement may be stopped. Even though the piston 180 is caught on the curb step 205 and stopped from moving, the guide 170 may be movable within the piston 180 and hence may further move downward. As a result, the gap between the piston 180 and the guide head 176 may be increased, and the first guide passage 172 may be opened.

As the piston 180 and the guide 170 are moved downward, the pressure inside the inflow space 202 may be increased. As a result, the content that had entered the inflow space 202 may sequentially pass through the first guide passage 172, the second guide passage 174, the valve passage 144, and the nozzle passage 117, to be sprayed through the orifice 124 to the exterior.

Since the helically shaped valve helical groove 146 is formed in the valve passage 144, the liquid content may form a vortical flow during movement. Due to this vertical flow, the content can be sprayed through the nozzle 110 in a uniform manner.

When the pressure inside the inflow space 202 is increased, the operating plate 194 of the disk 190 may be moved down by the pressure to close the inflow hole 208.

From the state illustrated in FIG. 4, when the external force is removed, the nozzle 110, valve 140, guide 170, piston spring 178, and piston 180 may generally be moved upward by the elastic restoring force of the valve spring 158. Here, as the piston spring 178 compressed as in FIG. 4 is elastically restored, the piston spring 178 may press the piston 180 downward with respect to the valve 140, whereby the piston 180 may quickly move down and close the first guide passage 172.

Figure 5:
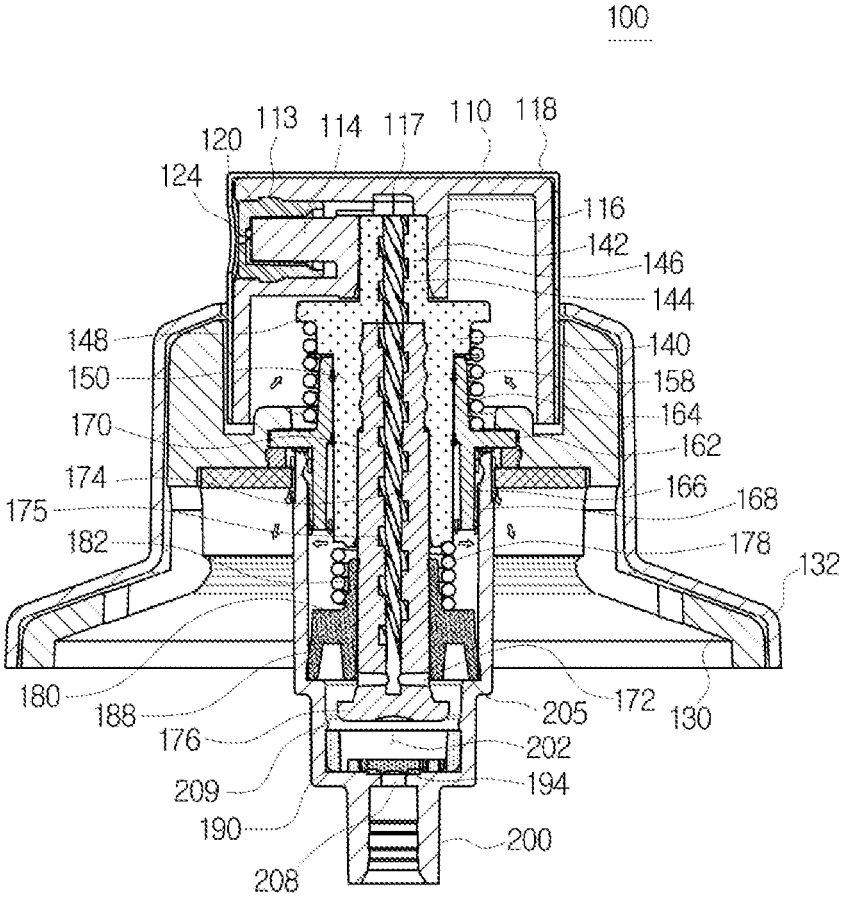
FIG. 5 is a cross-sectional view illustrating the entry of air in FIG. 4.

The following describes the inflow of outside air into a spray pump 100 according to this embodiment, with reference to FIG. 5.

FIG. 5 is a cross-sectional view illustrating the flow of outside air to the inside of the pump 100 and the container for a spray pump 100 according to an embodiment of the present invention. Incidentally, the arrows in FIG. 5 illustrate the flow of air.

Referring to FIG. 5, outside air may be drawn to the inside of the container. That is, air that enters through the gap formed between the nozzle cap 118 and the cap 130 may enter the inside of the nozzle 110 and then flow through the gap between the valve 140 and the housing cover 160, the gap between the housing cover 160 and the housing 200, and the gap between the housing 200 and the opening of the container, to enter the inside of the container. If the outside air does not enter the inside of the container in this manner, a vacuum would form inside the container, and it would not be possible to suction the content to the inside of the housing 200 with the weak vacuum generated in the inflow space 202. Thus, the passage for air movement may be formed to prevent the forming of a vacuum inside the container.

The inflow of outside air to the inside of the container and the spraying of the content that had entered the inside of the inflow space 202 can occur simultaneously.

While the foregoing provides a description with reference to an embodiment of the present invention, the person having ordinary skill in the relevant field of art would understand that various modifications and alterations can be made to the present invention without departing from the spirit and scope of the present invention set forth in the scope of claims below.

What is claimed is:

1. A spray pump comprising:

a housing having an inflow space and configured to be coupled to an opening of a container;

a housing cover coupled to an upper end of the housing;

a disk configured to open or close the housing according to a pressure of the inflow space;

a valve movably inserted through an inside of the housing cover, the valve comprising a valve head and a valve body connecting with the valve head;

a guide having a portion thereof inserted in the valve body and a remaining portion thereof positioned outside the valve body, the guide comprising a guide passage corresponding to a flow path for discharging a content;

a valve spring configured to provide an elastic force pressing the valve upward;

a piston movably inserted onto an outer perimeter of the guide and configured to open or close the guide passage by way of a vertical movement of the valve;

a nozzle coupled to the valve head and comprising an insert holder part; and an insert inserted in the insert holder part and comprising an orifice, wherein the valve head comprises a valve passage connecting with the guide passage, and a valve helical groove is formed in an inner perimeter of the valve passage.

2. The spray pump of claim 1, wherein the valve spring is inserted onto a periphery of the valve and has one end thereof supported by the housing cover.

3. The spray pump of claim 1, further comprising a piston spring positioned around the piston and configured to press the piston downward, wherein the piston spring has one end thereof supported by the piston and the other end thereof supported by the valve.

4. The spray pump of claim 1, wherein the guide passage comprises a first guide passage and a second guide passage, the first guide passage formed in a periphery of the guide, the second guide passage connecting with the first guide passage and formed along a lengthwise direction of the guide to connect directly with the valve passage, and wherein the piston is capable of opening or closing the first guide passage.

5. The spray pump of claim 4, wherein a guide helical groove connecting with the valve helical groove is formed in an inner perimeter of the second guide passage.

6. The spray pump of claim 1, wherein the valve helical groove is formed in two or more lines.

7. The spray pump of claim 1, wherein a gap allowing an entry of air to an inside of the container is formed at a coupling portion between the valve and the housing cover and at a coupling portion between the housing cover and the housing.

8. The spray pump of claim 1, wherein the piston comprises an inner piston and an outer piston, the inner piston configured to be movably inserted onto a periphery of the guide while maintaining tight contact, the outer piston separated from the inner piston by a particular gap in a radial direction and configured to tightly contact an inner perimeter of the housing, and wherein the housing comprises a curb step, the curb step configured to have the outer piston caught thereon.

* * * * *